US006755463B2

(12) United States Patent
Lardieri et al.

(10) Patent No.: US 6,755,463 B2
(45) Date of Patent: Jun. 29, 2004

(54) PORTABLE REFLEXOLOGY CHAIR

(76) Inventors: Gaetano Lardieri, 457 Third Ave. West, Newark, NJ (US) 07107; Mary Alice Arre, 155 Franklin Ave., Long Branch, NJ (US) 07740

( * ) Notice: Subject to any disclaimer, the term of this patent is extended or adjusted under 35 U.S.C. 154(b) by 0 days.

(21) Appl. No.: 10/389,533

(22) Filed: Mar. 4, 2003

(65) Prior Publication Data

US 2003/0164626 A1 Sep. 4, 2003

Related U.S. Application Data

(60) Provisional application No. 60/360,025, filed on Mar. 4, 2002.

(51) Int. Cl.[7] ..... A47C 4/00

(52) U.S. Cl. ..... 297/35; 297/353; 297/397; 297/423.36; 297/440.24

(58) Field of Search ..... 297/353, 397, 297/423.19, 19, 46, 16.1, 35, 51, 423.26, 423.36, 440.24

(56) References Cited

U.S. PATENT DOCUMENTS

| | | | | |
|---|---|---|---|---|
| 253,333 | A | | 2/1882 | Armstrong |
| 1,279,120 | A | | 9/1918 | Kellogg |
| 1,704,585 | A | | 3/1929 | Astruc |
| 2,233,797 | A | | 3/1941 | Potter |
| 2,642,250 | A | | 6/1953 | Kasnowich |
| 2,670,785 | A | | 3/1954 | Machet |
| 2,761,492 | A | | 9/1956 | Rechler |
| 2,872,969 | A | * | 2/1959 | Thomas |
| 2,919,746 | A | | 1/1960 | Fidel |
| 3,042,025 | A | | 7/1962 | Jackson |
| 4,142,520 | A | | 3/1979 | Herbold |
| 4,341,420 | A | | 7/1982 | Knowles et al. |
| 4,773,708 | A | | 9/1988 | Nastu |
| 4,792,181 | A | | 12/1988 | Guichon |
| 4,894,877 | A | | 1/1990 | Marsh |
| 4,913,393 | A | | 4/1990 | Wood |
| 4,941,222 | A | | 7/1990 | Prager |
| 4,955,517 | A | | 9/1990 | Maresca |
| 5,498,055 | A | | 3/1996 | Goldman |
| 5,560,679 | A | * | 10/1996 | Barnholdt |
| 5,570,926 | A | * | 11/1996 | Papiernik et al. |
| 5,636,900 | A | * | 6/1997 | Wilkie et al. |
| 5,642,542 | A | | 7/1997 | Kometani |
| 5,667,274 | A | * | 9/1997 | Blackman |
| 5,755,650 | A | | 5/1998 | Urso |
| 5,855,409 | A | * | 1/1999 | Tseng |
| 5,884,935 | A | | 3/1999 | Tholkes |
| 6,059,365 | A | | 5/2000 | Diamond |
| 6,113,181 | A | | 9/2000 | Tang |
| 6,154,899 | A | | 12/2000 | Brooke et al. |
| 6,185,769 | B1 | | 2/2001 | Larisey, Jr. et al. |
| 6,352,307 | B1 | * | 3/2002 | Engman |
| 6,435,617 | B1 | * | 8/2002 | McNair |
| 6,575,533 | B1 | * | 6/2003 | Kicos |

FOREIGN PATENT DOCUMENTS

DE 3707804 * 9/1988

OTHER PUBLICATIONS

Outdoor Living & Relaxing—1 page.

* cited by examiner

*Primary Examiner*—Milton Nelson, Jr.
(74) *Attorney, Agent, or Firm*—Arthur M. Peslak, Esq.

(57) ABSTRACT

What is disclosed is a portable chair specifically adapted for the unique needs of a professional reflexology therapy session. The chair is collapsible and provides numerous adjustments to fit the particular anatomy of each individual client.

2 Claims, 10 Drawing Sheets

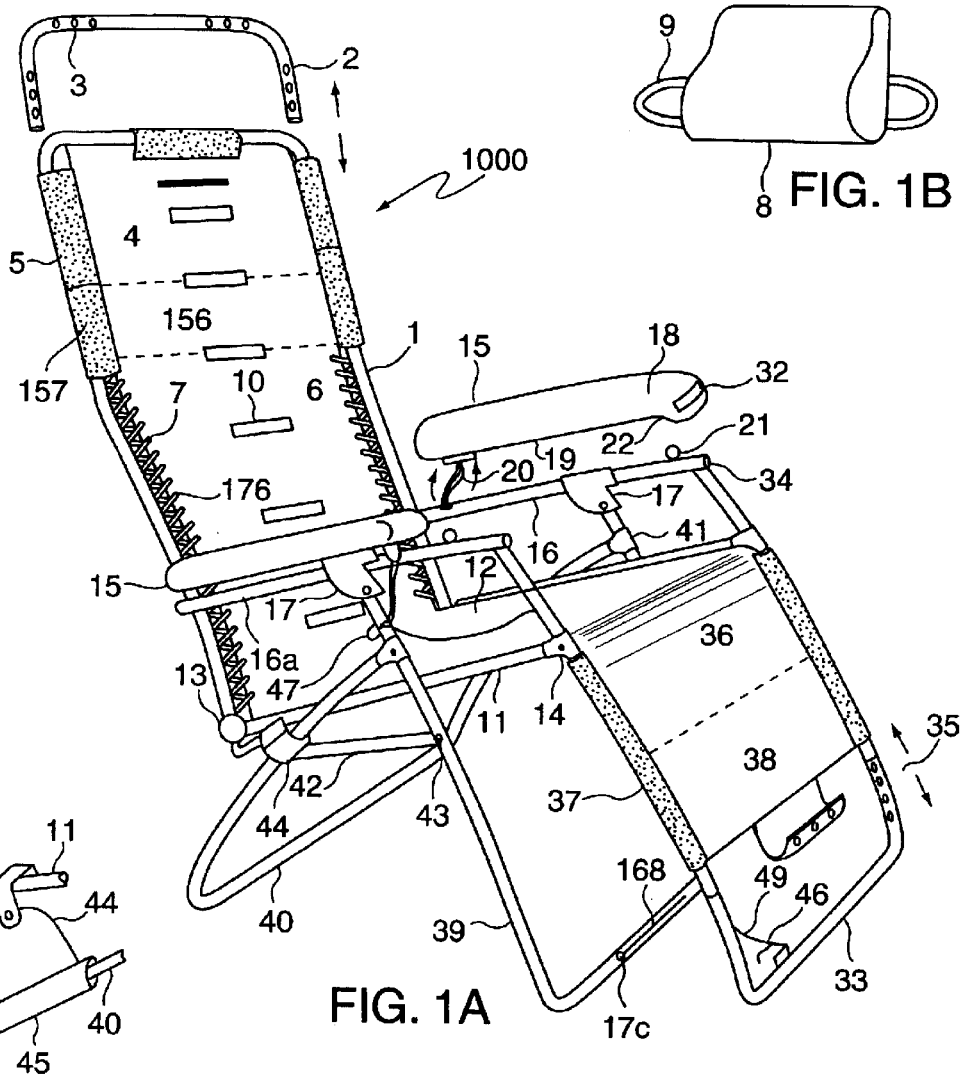
FIG. 1A
FIG. 1B
FIG. 1C
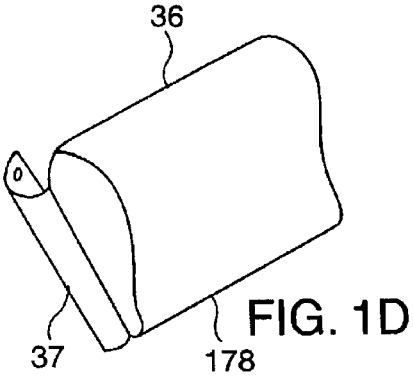
FIG. 1D
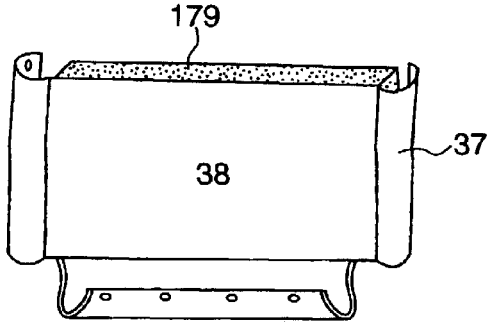
FIG. 1E 151
16
54
53
55
57
56
47

15
19
16
34
39
49
46
33

16
54
53
55
56
17
47
39

PORTABLE REFLEXOLOGY CHAIR

This application claims priority to United States Provisional Application No. 60/360,025 filed on Mar. 4, 2002.

BACKGROUND OF THE INVENTION

Many people throughout the world incorporate the use of Reflexology into their lives in order to relax, improve their overall health and enhance their well-being. Reflexology is an ancient art and scientific form of bodywork that is based on the premise that zones and reflex areas exist in the feet and hands that mirror all glands, organs and parts of the body. The Reflexology practitioner applies alternating pressure with the thumbs and fingers to specific reflex areas on the clients' feet, hands, ears and body which facilitates the following for the client: increased blood/lymph circulation, release of toxins, stress reduction, improved nerve functioning. Ultimately, this procedure aids the body in achieving a state of homeostasis/balance.

During a session both the client and the Reflexology practitioner must be positioned in a way so as to insure maximum comfort for the client and proper body mechanics for the practitioner.

Traditionally several methods of Reflexology have promoted the use of any available household reclining chair, various types of massage tables, and a collapsible easy chair (U.S. Pat. No. 5,570,926), none of which is designed specifically for administering Reflexology. For example, a chair that is not designed specifically for Reflexology does not take into consideration the varying heights of different people. If a person is reclining in a chair simply for the purpose of "lounging" then exactly where his/her feet rest, whether a few inches from the edge or even an inch or two over the edge, does not affect the overall function of the chair for the purpose of a persons general lounging comfort. But, during a Reflexology session the client's feet must be positioned to rest flush to the edge of the chair. If the client's feet are anything other than flush to the edge of the chair the ability of the practitioner to correctly perform certain techniques necessary for effective manipulation of the legs and feet is compromised.

In addition, the armrests of all standard manufactured chairs are stationary and do not allow for a person's arms to be situated in a way that suits his/her individual anatomy. Without the ability to adapt the armrests to fit the person: taller people may compensate by compressing their shoulders against the fixed arms (i.e., shrugged shoulders), shorter people may depress their shoulders (hanging due to lack of support) or, adjust themselves to sit on their sacrum or tail-bone which is improper body mechanics for sitting (slouching). Furthermore, immovable armrests do not enable the Reflexologist to easily access reflex areas on a client's arms and hands. To achieve accessibility for the practitioner and proper arm support and comfort for the client the armrests need to swing out or abduct.

In available collapsible easy chairs, as illustrated in U.S. Pat. No. 5,570,926, the chair armrests that are not only immovable and narrow, not fully supporting the arms, but they are also situated at an incorrect angle for a practitioner to correctly access the arms/hands of the client when a client is in either the upright or reclined position.

The locking mechanism on the available easy chairs is inadequate for the function of the practitioner who bears weight on the leg rest portion of the chair when working on a client's feet. The lock is not designed with the work of the Reflexologist in mind and is therefore not sufficient. The locking mechanism is also not situated in a location that is convenient for the practitioner to access during a session.

The pair of guiding forked yokes on the rear legs of the available collapsible easy chairs are open around the tubular frame of the legs and made of polyacetal plastic. Based on experience, it has been found that people weighing more than 200 pounds have broken these collapsible easy chairs and in each instance it was the guiding link that failed.

To date no piece of equipment has been designed specifically to address the inadequacies of the available chairs and facilitate the special needs of Reflexologists and their clients. Reflexology practitioners have compromised themselves, their clients and their profession for nearly a century by not having a chair designed specifically for their profession. Modern day Reflexologists have tried to compensate for this ergonomic void by "making due" and using common chairs that are not designed for the specific function of the Reflexologist.

The present invention is directed to solving the problems with available chairs. The present invention is directed to a chair that: adjusts to and supports people of varying heights and weights, has movable armrests and a locking mechanism that is more than adequate for weight bearing with larger clients and accessible to the Reflexologist during a session. Therefore, the present invention addresses the concern for the Reflexologists body mechanics and adapts to custom fit and properly support the individual anatomical structure of any client.

SUMMARY OF THE INVENTION

The present invention comprises a folding chair designed to be adjustable, portable and lightweight. It offers features that are mechanically and ergonomically designed to facilitate proper body positioning and body mechanics for both the client and the Reflexology practitioner respectively.

The armrests of the chair are designed with 2" foam that is concave along the middle, allowing the arm of the client to rest comfortably and be fully supported in this concave groove. The armrests also pivot out (abduction) and in (adduction) allowing the practitioner easy access to the client's limb at a variety of angles. The height position of the armrest adjusts in order to accommodate the specific length of a client's upper arm from shoulder to elbow. This height adjustment will allow the chair to comfortably accommodate a client of any size or with any shoulder pathology by allowing for a proper angle at the shoulder/neck region preventing additional or unnecessary tension in that area.

The leg rest section of the chair frame is designed to telescope the frame longer or shorter so as to accommodate people of varying heights. This feature is necessary, as the client's feet must rest flush to the edge of the bottom of the chair when the client is in the chair in the reclined position. This built-in telescoping design allows the practitioner to properly manipulate the feet, ankles and legs of the client without compromising the practitioner's body mechanics. Once the leg portion of the frame is either shortened or lengthened, individual, interchangeable, sectional cushions at the leg of the chair will accommodate the change. This is accomplished by simply snapping the appropriate cushion on or off as needed.

The head/shoulder portion of the frame is designed to telescope upward so as to lengthen the frame. Sectional cushion panels are also provided at the head and upper back portion of the chair. The panels function in the same way as they do at the leg rest section of the chair. If a practitioner chooses to manipulate the client's head, shoulders or upper back the frame can be extended and the cushions can simply be unsnapped and removed or dropped down allowing for open access to the client's head, neck, shoulders and upper back. Although this type of manipulation is not common in the use of foot Reflexology, practitioners of varying modalities such as body Reflexology, acupressure, massage and Reiki will find this feature useful.

A dual lever, lock-in-position brake system, is designed for easy use for positioning the chair and guarantees that the chair is securely locked into position. Two quick-release levers are positioned one at the foot end of the frame and one at the hand end of the armrest. When either one of these levers is released the other will automatically release as well. Releasing either lever will disengage a brake shoe and allow the Reflexologist to easily adjust the reclining angle of the chair at any time during a session.

BRIEF DESCRIPTION OF THE SEVERAL VIEWS OF THE DRAWINGS

FIG. 1A is an oblique perspective of the Reflexology Chair of the present invention in the upright position.

FIGS. 1B, 1C, 1D and 1E are perspective views of components of the present invention.

DETAILED DESCRIPTION OF THE INVENTION

Figure 2A:
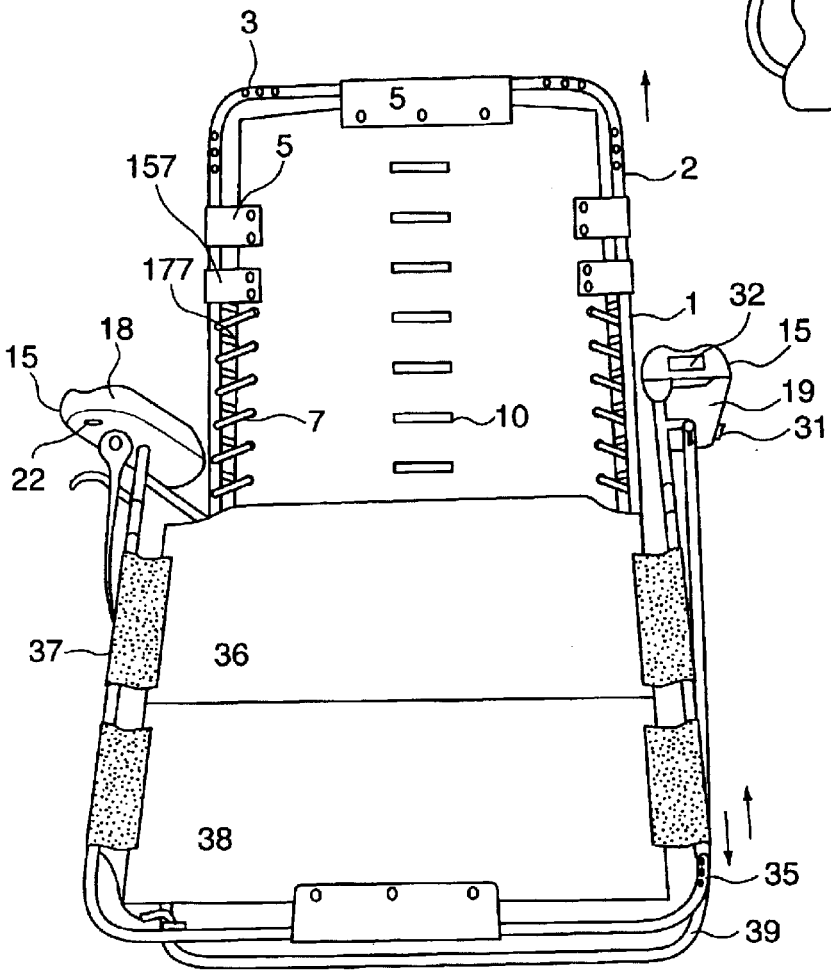
FIG. 2A is a front view of the Reflexology Chair in the upright position.
Figure 2B:
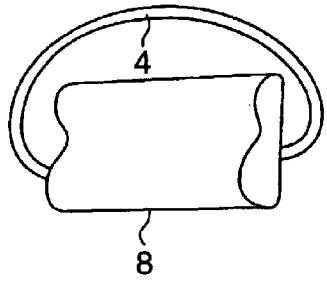
FIGS. 2B, 2C, 2D, 2E and 2F are perspective views of components of the present invention.
Figure 2C:
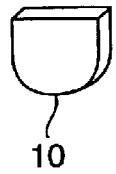
Figure 2D:
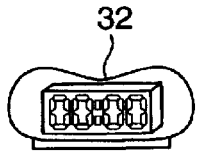
Figure 2E:
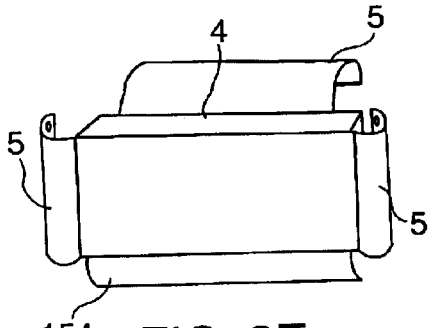
Figure 2F:
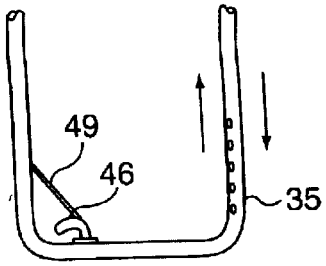
Figure 3D:
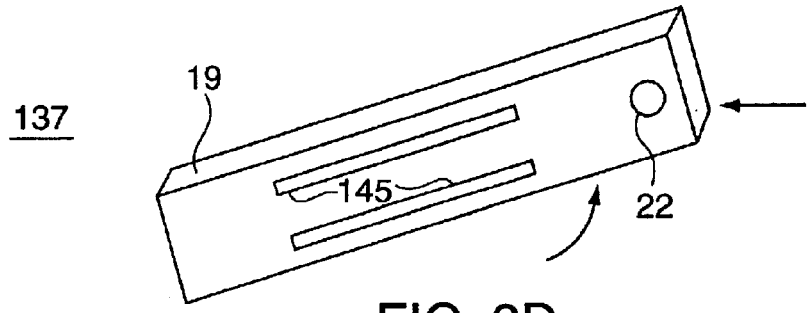
FIGS. 3A, 3B, 3C and 3D are views of components of the present invention.
Figure 3C:
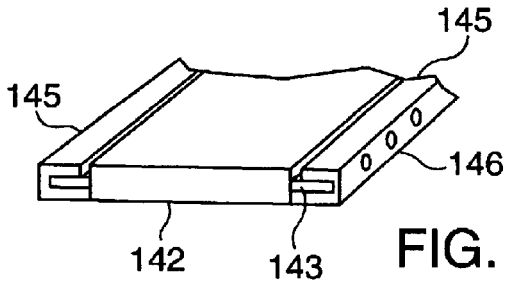
Figure 3B:
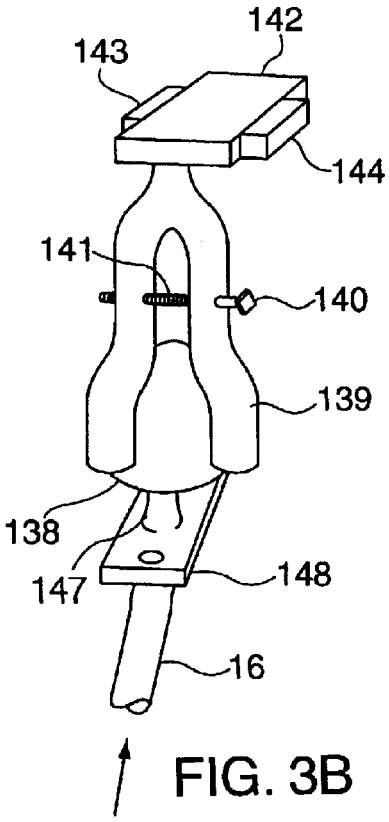
Figure 3A:
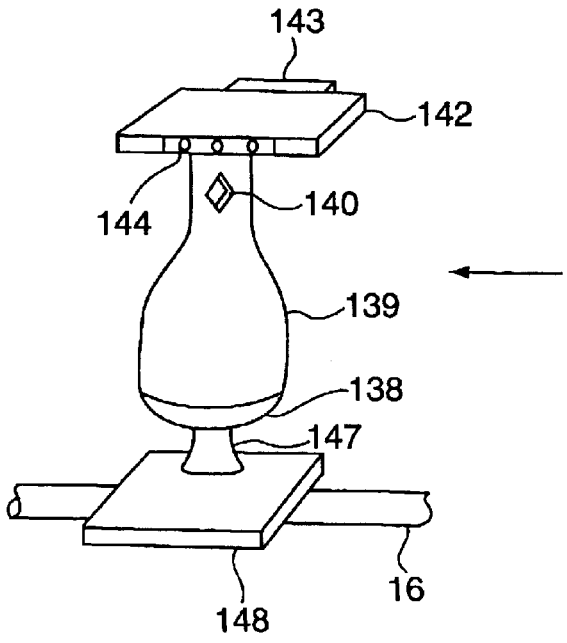

The present invention will now be described in detail by reference to the presently preferred embodiment as illustrated in the attached drawings. However, as is well known to those of ordinary skill in the art, many obvious variations may be made to this embodiment without departing from the spirit or scope of the present invention as set forth in the claims.

The present invention is directed to a Portable Reflexology Chair 1000 as shown and described herein. The Chair 1000 is a portable reclining chair with an overall basic rectangular shape that folds in two places (bi-fold). The chair comprises a tubular frame 1 made of graphite, steel, aluminum, magnesium or any other suitable metal.

As shown in FIG. 1 the Chair 1000 comprises the frame 1 that forms the back of the chair. The back of the frame I is slightly curved so as to follow the natural curve of the spine. The top of the back of the frame 1 or head area is adjustable and telescopes upward to an additional 3" to 6" in length. The head of the back frame 1 comprises insertable tubing 2 that slides up or down within the tubular frame 1. The chair comprises a plurality of pinhole clip adjusters on both sides of the frame 1 that lock the tubing 2 into place when the desired height is reached.

The presently preferred embodiment comprises three pairs of through holes 3 in the top horizontal portion tubular frame 1. The holes 3 are spaced approximately ½" apart. Three of the holes are on the left and three of the holes are on the right side. The holes 3 are adapted to receive the utility hooks.

The back portion of the chair is divided into three sections; a head/neck section 4, an upper back section 156 and a mid to lower back section 6.

Figure 6B:
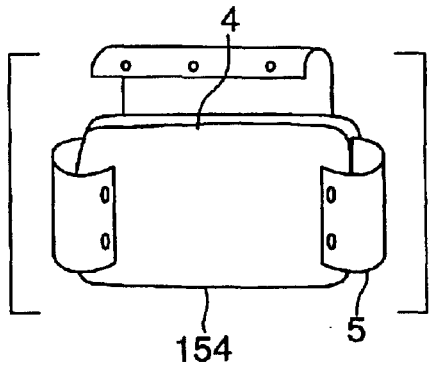
FIG. 6B is a view of components of the present invention.
Figure 6A:
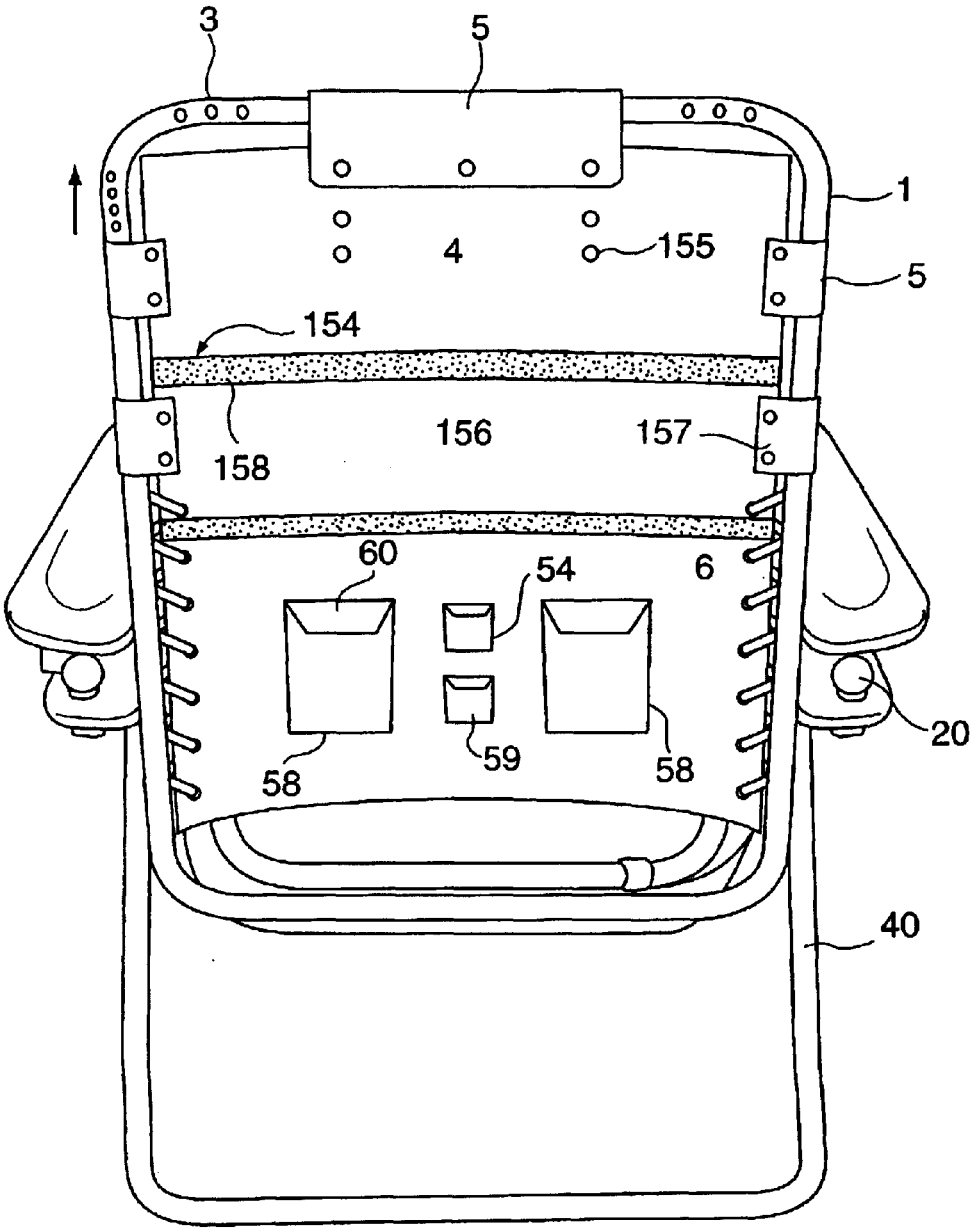
FIG. 6A is a back view of the Reflexology Chair of the present invention in an upright position.

An interchangeable cushion at the head/neck section as shown in FIGS. 2 and 6 attaches/detaches via snap-on cuffs 5 to the sides of the frame 1. A Velcro strip 154 at the lower end of the cushion adheres to a mating Velcro strip on the upper end of the upper back section 158.

The top cuff 5 of the cushion 4 that wraps around the cross bar at the head of the frame is adjustable via snaps on the back of the cushion as shown in FIG. 6 thus accommodating the telescoping ability of the head portion of the frame. The top portion of the back frame 1, telescopes with tube 2 to extend the frame of the chair vertically 3" to 6" for more open access to the client's head/neck. The cushion 4 is flat on the surface and in the present embodiment measures approximately 24 inches across by approximately 7" long and functions to create a complete and stable back support for the chair. Each cushion is covered with canvas, leather or any other suitable material to match the seat padding 6 and 12 of the Chair 1000. If a practitioner chooses to manipulate the clients' head, shoulders or upper back the cushion 4 can simply be unsnapped and removed for open access to the client's head, neck and upper back. To re-attach the cushion 4, the practitioner simply snaps the cushion along the side of the tubular frame 1 and upper cross bar and then secures the Velcro strip 154 to the mating Velcro strip 158 on upper-back cushion 156 thus adhering the head and upper back cushions to one another.

The cushion of the upper back section 156 of the back portion of the chair measures approximately 24" across and approximately 7" long in the present embodiment. The cushion 156 itself is moveable in order to render the clients' upper back accessible to the practitioner in the same way as the head/neck area panel. This upper back cushion 156 attaches/detaches via cuffs 157 that snap on/off the side tubing of the back frame 1 of the chair. The upper back cushion 156 and the mid to lower back cushions 6 on the backside of the chair form one continuous piece.

On the front side of the chair FIG. 2, a seam is sewn between the upper back cushion 156 and the mid to lower back cushions material 6 thus allowing for a slight separation between the two cushions when the upper back cushion 156 is folded down and back. When the cuffs 157 on the side of the cushion 156 are unsnapped the upper back panel's cushion will drop down and away to the backside of the chair allowing open access to the client's upper back.

The padding of the mid to lower back portion 6 of the chair is attached to the tubular frame 1 with high tension elastic cording 7 which passes alternately through eyelets 176 in the fabric and through metal loops 177 welded to the frame 1. This lower back padding 6 is continuous with the seat padding 12.

Included with the primary design of the Reflexology Chair is a removable and adjustable head pillow 8 as shown in FIGS. 1 and 2. The head pillow consists of memory foam that is covered with canvas or other material to match the material of the chair. The pillow 8 is of a curved design that supports the natural contour of the neck and measures approximately 18" wide and 7" long. Sewn to the back seams of the removable cover is a material covered elastic band 9. Both ends of the elastic band 9 are sewn so as to create a strap that is then placed over the head portion of the back of the frame 1. The elastic band 9 holds the pillow 8 in place for the client once it is in place or when the Chair 1000 is being transported.

Figure 7:
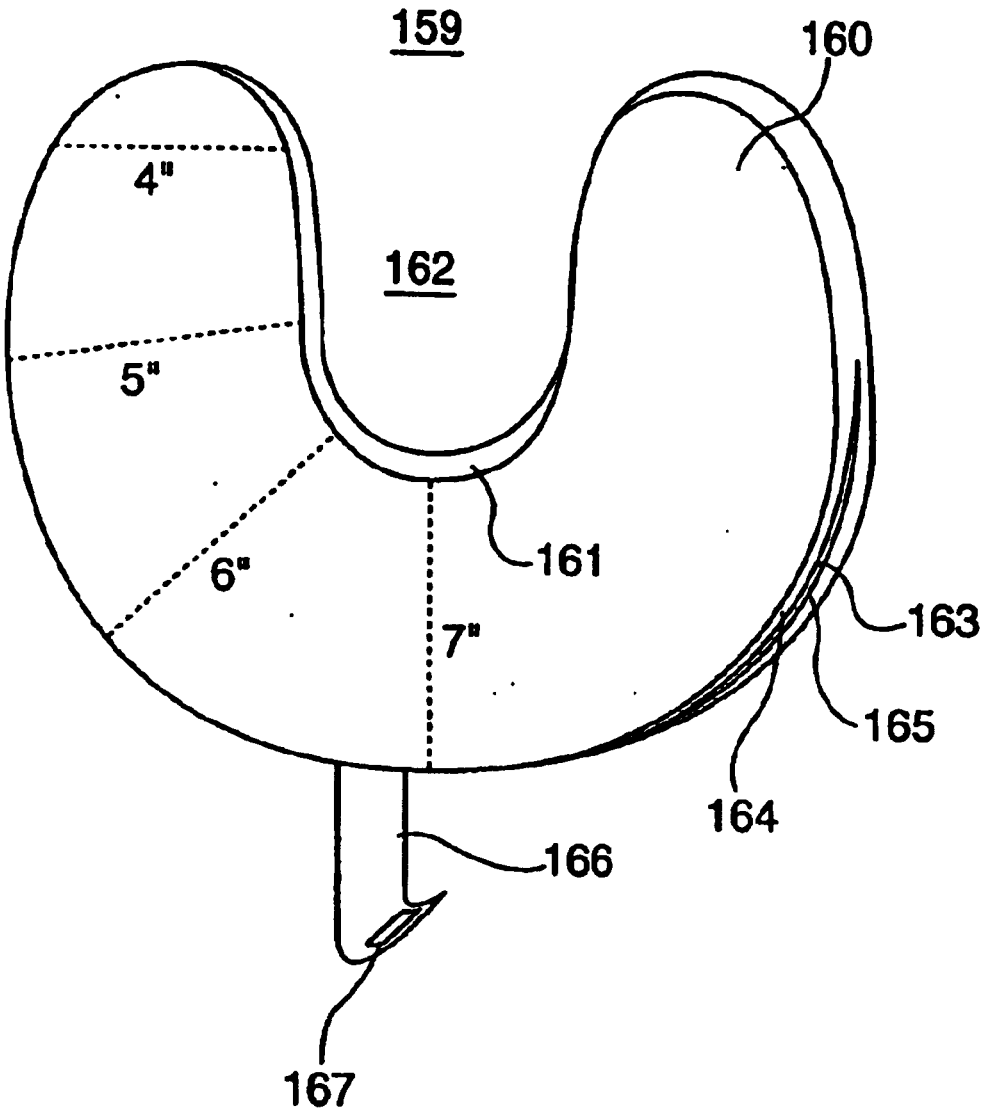
FIG. 7 is a top view of an alternate head pillow for the present invention.

The preferred design for the head pillow 159 is illustrated in FIG. 7, the pillow 159 generally is U-shaped, and comprises a pair of lateral sections 160 joined by a bridging section 161 to define an open central area 162. Lateral sections 160 are curved to provide comfortable contoured support to the head/neck. The bridging section 161 is broader and thicker than the lateral sections 160. The bridging section 161 is about 3" thick and the lateral sections 160 are about 2" thick. The head pillow 159 is filled with buckwheat, flax seeds or other similar material making it pliable so it contours to the shape of an individual's head. The pillow 159 further comprises a zippered opening 163 along the mid-seam of the pillow 159 that is about 8" long. Inside the pillow 159 is a thin cotton casing 164 shaped in the same fashion as the pillow 159. The casing 164 has a zippered opening 165 for access to the filling material. At the bottom of the U-shape of the pillow 159 there is a material strap 166 sewn to the seam that is about 1" wide and 6" long. The strip 166 forms a loop and has a Velcro strip 167 on each end. The strap is used to affix the pillow 159 to the tubular frame 1 when the Chair 1000 is being transported.

As shown in FIGS. 1 and 2, the Chair 1000 further comprises a plurality of semicircular shaped inside pockets 10 sewn into the portion of the chair where the clients' head and back rests. The pockets 10 are opened at the top and measure about 3" across. The pockets themselves are hidden between the outer material covering of the chair and the inner foam padding so that only the horizontal opening slot 10 is visible on the chair. The pockets 10 are centered and aligned vertically from the top of the head area of the Chair 1000 to the chair's base where the client's lower back would rest. The upper pockets are situated on the removable cushions 4 and 156. These pockets correspond to the seven Chakras of reflexology, which is known to those of ordinary skill in the art as the top of the head, eyes, mid-neck, heart, solar plexus, navel, base of the spine. Practitioners utilizing Gemstone, Crystal, Color or Magnetic therapy to aid in balancing the Chakras can place one or any combination of these healing instruments into the pockets 10 before the client is seated. The instruments will imbed within the chair's cushioning so as not to interfere with the comfort of the client who will not feel these objects on her/his back.

As shown in FIG. 1 there are two parallel side members 11 that form a seat structure 12 for supporting an occupant. The side members 11 connect to hinged members 13 and 14 which in turn connect to the back of the frame 1 on the other end, the side member 11 connects to the upper portion of the leg rest 33.

The width of the frame of the Chair 1000 is approximately 25". The seat padding 12 is made of canvas, leather or any other suitable material which covers 1" thick closed cell foam or other suitable material. The seat padding 12 is attached to the frame with high tension elastic cording 7 which passes alternately through eyelets 176 in the fabric and through metal loops 177 welded to the side members 11. The seat of the chair from buttock to knee measures approximately 21".

The Chair 1000 further comprises a pair of armrests 15 that are parallel with each other and with the side members 11. Beneath each armrest 15 is a sliding rod 16 that articulates to the back frame 1. The sliding rod 16 moves through a sliding forked yoke 17 that is attached at its lower end to the upper portion of the front leg unit 39.

The armrests 15 of the chair are approximately 5" wide and 20" long. The armrests 15 are provided with upper cushioned portions 18 made of 2" thick covered closed cell foam material that is formed with an upper concavely surface along its length to provide a comfortable armrest for the clients. The cushion 18 is attached to 1/16" thick plastic sheet that forms a base 19 to the moveable armrest 15.

At the rear of the armrest 15 where the client's elbow will rest the armrest 15 connects to a slide rod 16. The armrest 15 connects to the slide rod 16 by means of a ball and socket swivel mechanism. The swivel mechanism 20 allows the armrest 15 to pivot outward (abduct) to any desired position up to 180 degrees and/or allows the armrest 15 to be raised to suit the comfort of the client. The ball and socket mechanism 20 is adjustable via a handled turn screw 25 that is easily accessed by the practitioner. When the turn screw 25 is loosened, the front of the armrest 15 is lifted off its front ball mount 21, moved to the desired position and then simply tightened in order to lock and secure the armrest 15 in its new position. There is a concavity 22 designed into the plastic underside 19 of the armrest 15 at the front end. There is a ball 21 made of the same metal as the tubular frame 1 that is welded to the front end of the slide rod 16. When in standard resting position the concavity 22 of the armrest 15 fits onto the ball 21 to give the arm added stability.

Figure 9:
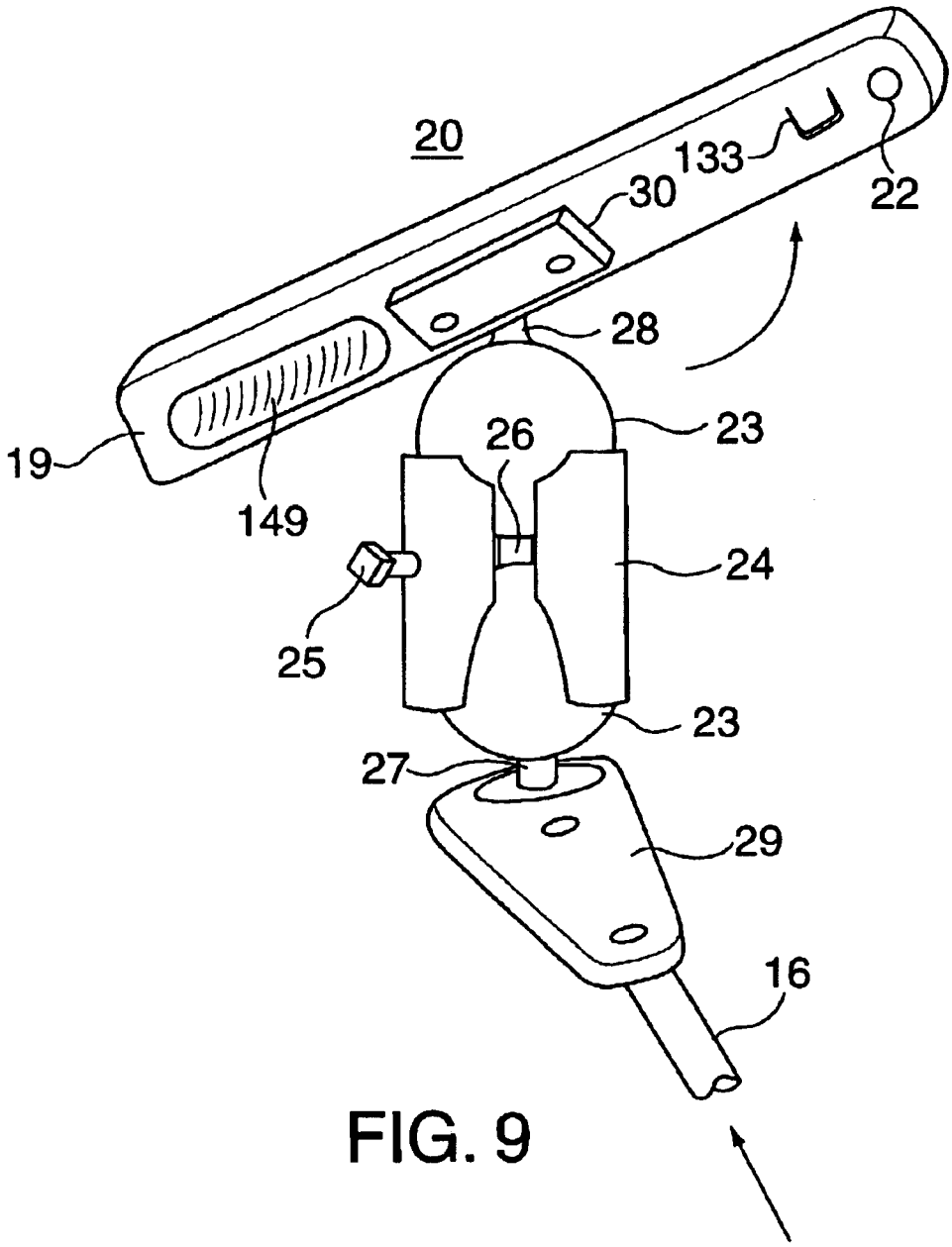
FIG. 9 is a perspective view of a component of the present invention.

As shown in FIG. 9, the ball and socket swivel mechanism 20 is designed with two approximately ¾" solid balls or spheres 23, one each inserted on either end within a split sleeve or housing tube 24 that encases the spheres 23. The housing tube 24 is about 2" in length and is separated vertically down the middle. A turn screw 25 is situated on the outside half of the housing tube 24, and in turn is attached to a rod and spring 26 on the hollow inside of the housing tube 24. The two halves of the housing tube 24 can be moved closer together or further apart by turning the screw 25. Once the armrests 15 are in the desired position, the turn screw 25 is tightened in order to bring the two halves of the housing tube 24 together to close the tubing around the spheres 23 thus preventing further movement of the spheres 23. Attached to, as an extension of, each sphere 23 is a ⅛" solid rod 27 and 28. Each rod acts as a bridge between the ball 23 and the stable surface to which it is attached. Two flat pieces of metal or polyacetal plastic 29 and 30 act as anchors for rods 27 and 28. The anchor 29 for ball rod 27 is secured toward the rear of the stable slide rod 16. The second anchor 30 for ball rod 28 is secured to the underside of the plastic portion 19 of the armrest 15. The armrest 15 further comprises a concavity 149 in its rear underside where the housing tube 24 will rest flush into when the armrest 15 is in a stationary position.

Figure 10:
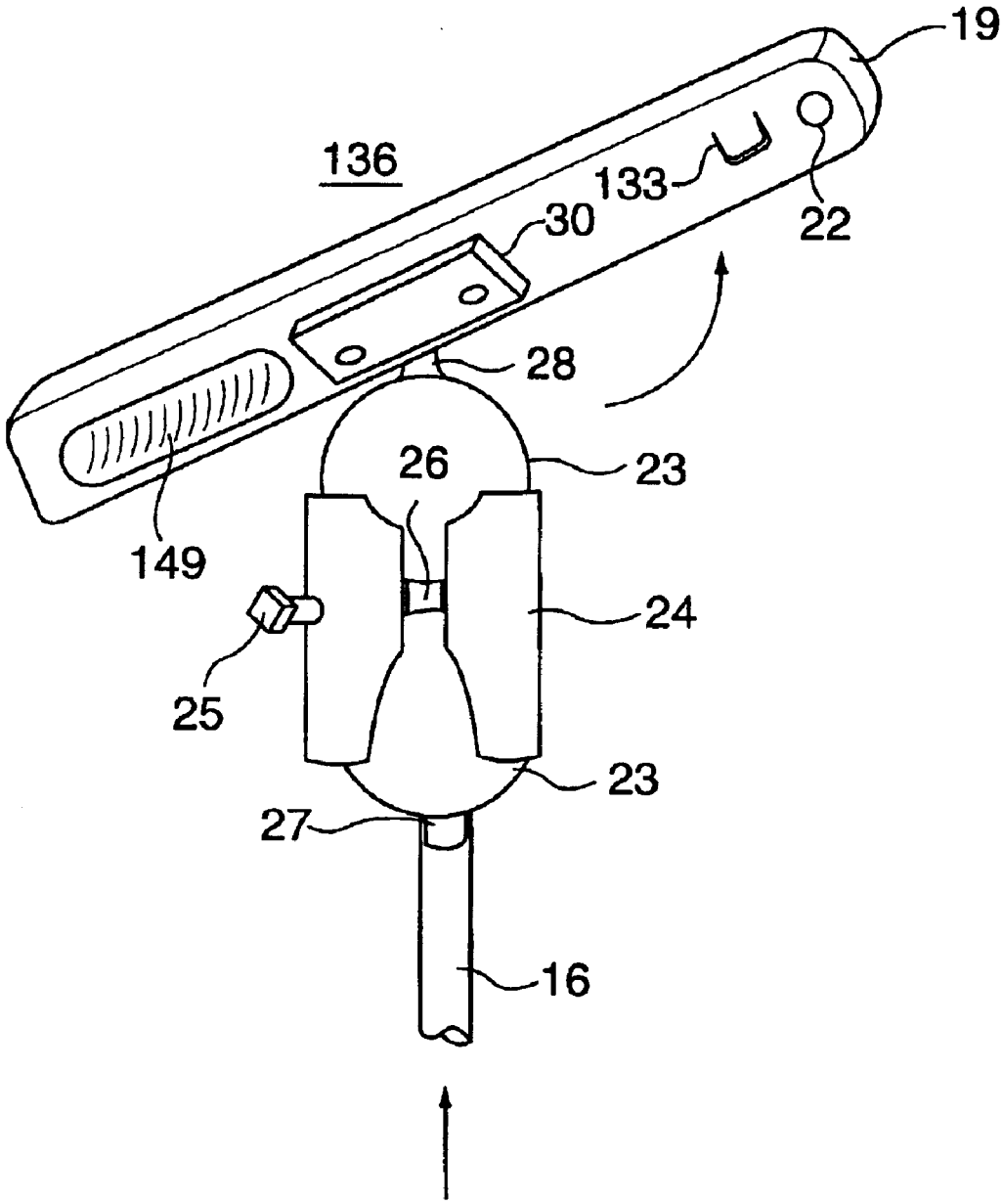
FIG. 10 is a perspective view of component of the present invention.

As shown in FIG. 10, an alternative embodiment for the mounting of the ball and socket mechanism 136 differs in that rod 27 is welded to the rear of the stable slide rod 16 thereby eliminating the anchor 29 that fits between or is mounted to, the slide rod 16 and the ball rod 27.

A second, and preferred, alternate embodiment for the ball and socket swivel mechanism 137 is illustrated in FIG. 3.

The mechanism 137 comprises a single ball 138 nesting within a housing tube/socket 139. The housing tube 139 is a split-sleeve that opens/closes around the ball 138 via a turn screw 140 situated on the outer side of the housing tube 139. On the inside of the housing tube 139 is a resistance spring 141. The housing tube 139 tapers inward above the turn screw 140 extending upward and attaches to a flat surface above it that functions as an anchor 142 to the plastic underside 19 of the armrest 15. The anchor 142 to the armrest is flanked on either side by a slide bar 143 with pin balls 144 on the outer side of the slide bar. The slide bars 143 are adapted to slidingly fit on a two-railed guide track 145 attached to the underside of the armrest 19. The outer (lateral) guiding track 145 is provided with a plurality of holes 146 on its outer side. The housing tube 139, anchor 142 and sliding bar 143 are manufactured as one piece. The sliding bars 143 are adapted to fit within the guiding track 145. The pin balls 144 act as a lock/stop device within the holes 146 of the guiding track 145. The sliding feature enables the armrest 15 to move forward or backward, and when doing so, the housing tube 139 roles over the ball 138 for ease of movement. Thus, the armrest 15 will fit specifically to any client's structure. The ball 138 within the housing tube 139 comprises at its lower end an extending rod 147 which is welded to a flat piece of metal that functions as an anchor 148 attached to the slide rod 16. Alternately and preferably, the anchor 148 may be eliminated and the extending rod 147 can be directly welded to the slide rod 16. The ball 138 as it is fitted in the socket 139 enables the armrest 15 to rotate up to 180 degrees outward and any other number of desired angles and directions.

As shown in FIG. 2, an open slot 31 is provided in the right and left outside plastic frame 19 of the armrests 15. The slot 31 functions as a cup holder for the convenience of the client.

A 1¼" by 2", battery or solar powered, digital, illuminated clock 32 is inset in the front left armrest 15 making it visible to the practitioner when she/he is seated at the feet of the client.

A U-shaped frame forms the leg rest 33 of the Chair 1000. The top of the leg rest 33 is connected to the slide rod 16 by a cylindrical hinge 34 that acts as a pivot pin and is perpendicular to the plane of symmetry of the chair.

The length of the chair in the reclined position ranges from, at its shortest length approximately 60", to accommodate a person 5' tall, to approximately 76" at its longest length, to accommodate a person up to 6'4" tall. The portion of the chair where the client's back rests measures approximately 28" from the top of the back frame 1 down to the seat portion 12. The seat of the chair from buttock to knee measures approximately 21".

The Chair 1000 further comprises an adjustable telescoping leg feature that operates via insertable tubing 35 aligned with pinhole clip adjusters built into the left outer side of the frame of the leg rest 33 that stop and lock the frame to its desired length. The leg rest 33 from knee to foot measures at its shortest length 11" to 26" at its longest extended length. The telescoping leg feature 35 allows the frame of the chair to be shortened up to 11" or lengthened up to 5" from the standard length of 71".

The Chair 1000 further comprises interchangeable sectional leg cushions 36 and 38 that attach/detach via snap-on cuffs 37 to the sides of the frame of the leg rest 33. The cushions 36 and 38 measure 24" wide by about 8" long. The cushions 36 and 38 are designed with a variety of thicknesses and contours or curves according to the effect the practitioner wants to achieve based on the needs of the client. The cushion 36, which is positioned to bolster the knees and contours to support the angle behind the knees measures approximately 24" wide/across, about 3" at its highest or thickest point and gradually declines to about a ½". The cushion for the lower part of the leg 38 is approximately 24" across and about 1½" thick and flat across the surface or without contour.

Each leg cushion 36 and 38 is covered with removable canvas, leather or any other suitable material to match the seat padding 12 of the chair. There are several cushions with dimensions similar to cushion 38 which is a firm cushion made of closed cell foam.

One is a soft cushion made of memory foam and another cushion is filled with flax seed or other suitable material that can be microwave heated. The cushions will have sewn to either side a square flap of material acting as a cuff 37 that will wrap around the frame tubing of the leg rest 33 and snap closed on the back/underside of the cushion. When the desired cushions 36 and 38 are in place, they will fit flush against one another and form a stable padding for the client's legs. As the two cushions 36 and 38 are pushed up against one another, each edge will meet the other with Velcro strips 178 and 179 thereby adhering the cushions 36 and 38 firmly together. The practitioner can use as many or as few cushions as are needed to accommodate the height and pathology of any client.

A front leg unit 39 and a rear leg unit 40 that articulate about a connecting forked yoke 41, one on the right side and one on the left side, form the base of the chair. A linkage bar 42 on each side connects the legs of the leg units 39 and 40 so that they move together as the chair is folded or unfolded. Each linkage bar 42 has a front end that is attached via a pivot pin 43 to the front leg unit 39. The back or rear end of each linkage bar 42 is attached to a guiding forked yoke 44 that slides down the rear leg 40 away from the connecting forked yoke 41 when the leg units 39 and 40 are pushed together to close the chair. The linkage bar 42 is about 11" long and functions to stabilize the front and rear leg units 39 and 40. When the chair is opened, the front and rear leg units 39 and 40 rest about 28" apart from one another at the base. The linkage bars 42 thus prevent the front and rear leg units from separating beyond a certain angle. A guiding forked yoke 44 is fixed to the side member 11 toward the rear end. The guiding rod 45 of the guiding forked yoke 44 completely wraps around or encloses the tubular frame of the rear leg 40 and is made of steel, magnesium or any other suitable metal. The upper end of the front let unit 39 is attached to the lower end of a sliding forked yoke 17 that is arranged to slide along the slide rod 16 that is beneath each armrest 15.

Figures 4A, 4B:
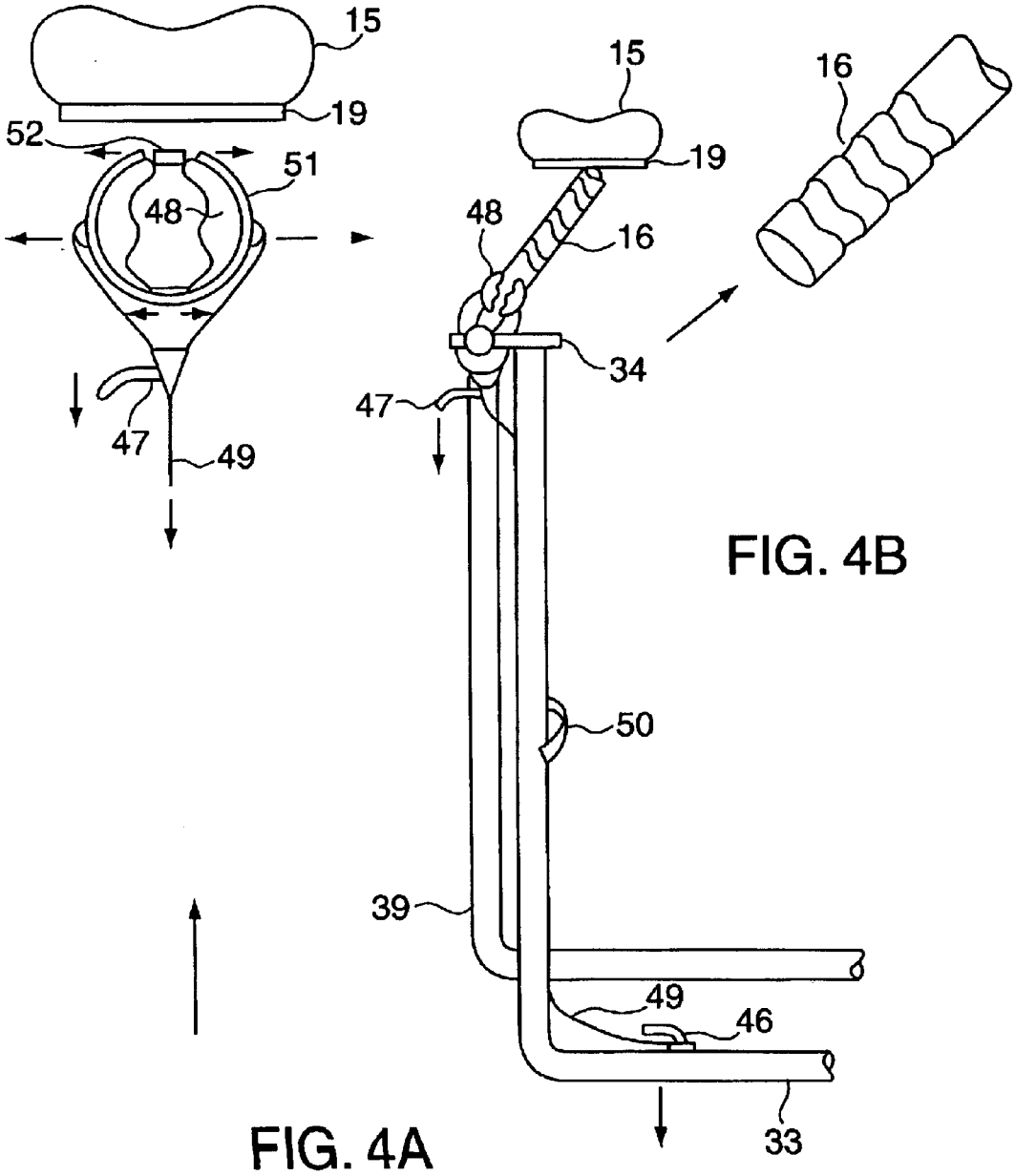
FIGS. 4A and 4B are views of components of the present invention.

Attached to the slide rod 16 beneath the right armrest 15 is a lever actuated brake mechanism as shown in FIG. 4. A dual lever, lock-in-position brake system 150 is designed to securely hold the Chair 1000 in a locked position. The two quick-release levers 46 and 47 are positioned one at the right foot of the frame of the leg rest 33 and one lever 47 at the front end of the slide rod 16 beneath the right armrest 15. When either of these levers is released/activated the other will automatically release as well. Releasing either of the levers 46 or 47 will disengage a pair of semi-circular brake shoes 48 that are positioned one on either side of the tubular slide rod 16 under the right armrest 15. The tubular frame of the slide rod 16 and the brake shoes 48 are designed in a "tongue and groove" fashion so that the tongued brake shoes 48 and the grooved tubular slide rod 16 are fitted together and will not move/slide when engaged. The brake shoes 48 will always be engaged (locked in position) until they are released by either lever 46 or 47. The location of the release levers 46 and 47 enables the practitioner to easily disengage the brake shoes 48 and adjust the reclining angle of the chair at any time before or during a session. The lever 46 that is mounted at the right foot end of the leg rest 33 is attached to a cable 49 that runs along the back right side of the frame of the leg rest of the chair. The cable 49 is held in place by eyehooks 50 that are welded to the frame of the leg rest 33. The length of the cable allows for slack when the chair is folded or unfolded. The cable 49 engages the second lever 47 that is positioned under the right armrest 15 and is mounted on the upper end of the right front leg unit 39. Above the second lever 47, the cable 49 splits and attaches to a metal cap 51 that houses a pair of convexly expanded brake shoes 48 that grasp the tubular slide rod 16. The metal housing 51 of the unit is held tightly together around the tubular frame of the slide rod 16 by two spring coils 52. When either lever 46 or 47 is activated/released at either end, the cable 49, pulls the coils 52 away from the midline so as to disengage the housed brake shoes 48 and allowing for a gliding movement along the slide rod 16. When the desired position of the chair is reached the lever is released and the convexity of the brake shoes 48 fit is adapted to in the concavity of the slide rod 16 once again engaging the brake mechanism.

Figures 5A, 5B, 5C:
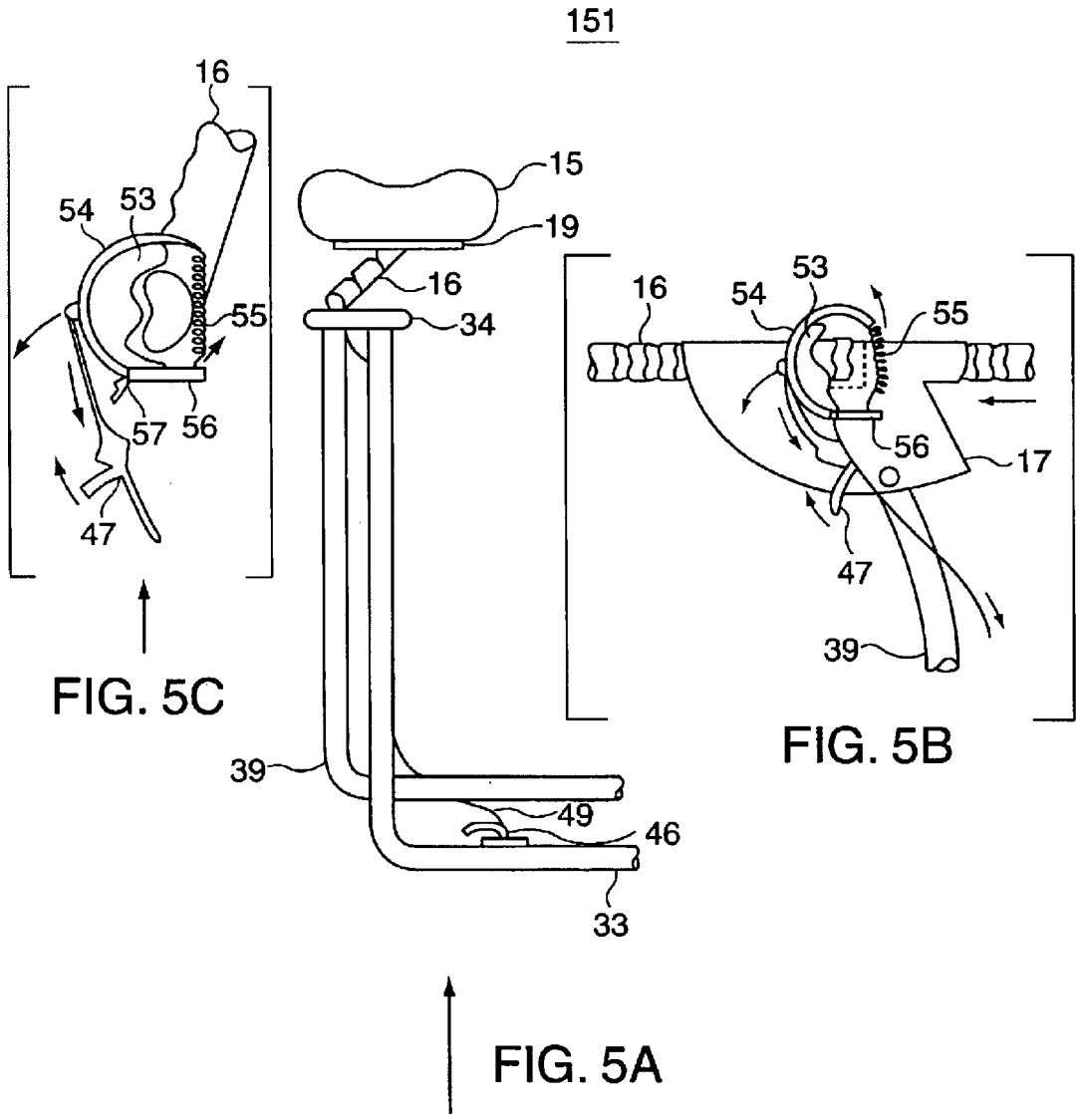
FIGS. 5A, 5B and 5C are views of components of the present invention.

An alternate design for the braking mechanism 151 is illustrated in FIG. 5. The breaking mechanism 151 comprises one semi-circular brake shoe 53 that is positioned on the outside of the tubular slide rod 16 under the right armrest 15. The outside of the tubular frame of the slide rod 16 and the brake shoe 53 are designed in a "tongue and groove" fashion so that the tongued brake shoe 53 and the grooved tubular slide rod 16 are fitted together and will not move when engaged. The brake will always be engaged or locked in position until it is released by activating/releasing either of the levers 46 or 47. The levers 46 and 47 and cable mechanism 49 for this alternate design are the same as the mechanism 49 shown in FIG. 4 up to the point of the second lever 47 beneath the right armrest 15. In the alternate design 151, the second release lever 47 is mounted on the outer side of the sliding forked yoke 17 beneath the right armrest 15. Above the second lever 47, the cable 49 is attached to a metal cap 54 that houses the brake shoe 53. The metal cap 54 wraps three-quarters of the way around the tubular slide rod 16. At the top of and attached to the metal cap 54 that extends out over the slide rod 16 a tightly coiled spring 55 drops down the inner side of the slide rod 16, opposite the brake shoe 53. At its bottom, the spring 55 is attached to an anchor bolt 56 on the underside of the brake shoe housing 54. The brake shoe 53 is convexly expanded and grasps the tubular slide rod 16 that is alternately concavely notched on the outer and upper side. The single brake shoe 53 is housed within, and is part of the sliding forked yoke 17 that enables the slide rod 16 to move through it. When the brake 53 is engaged, its housing 54 rests flush within the sliding forked yoke 17 and the brake shoe 53 rests in the grooves of the slide rod 16. The forked yoke 17 in this design is made of aluminum, steel or some other suitable metal whereas in other designs it is made of polyacetal plastic. The brake shoe 53 pulls out and away from the slide rod 16 via a hinge or pivot pin 57 that is situated at the lower end of the brake shoe cap 54. When either of the levers 46 or 47 is activated at either end, the cable 49 pulls the metal brake shoe housing 54 on its pivot pin 57, down and away from the midline, in turn pulling the coil 55 up so as to disengage the brake shoe 53 from the slide rod 16 enabling a gliding movement along the slide rod 16. When the desired position of the chair is reached the levers 46 and 47 are released, the coil 55 tightens again, and the convexity of the brake shoe 53 rests in the concavity of the slide rod 16 once again engaging the brake mechanism.

Figure 8A:
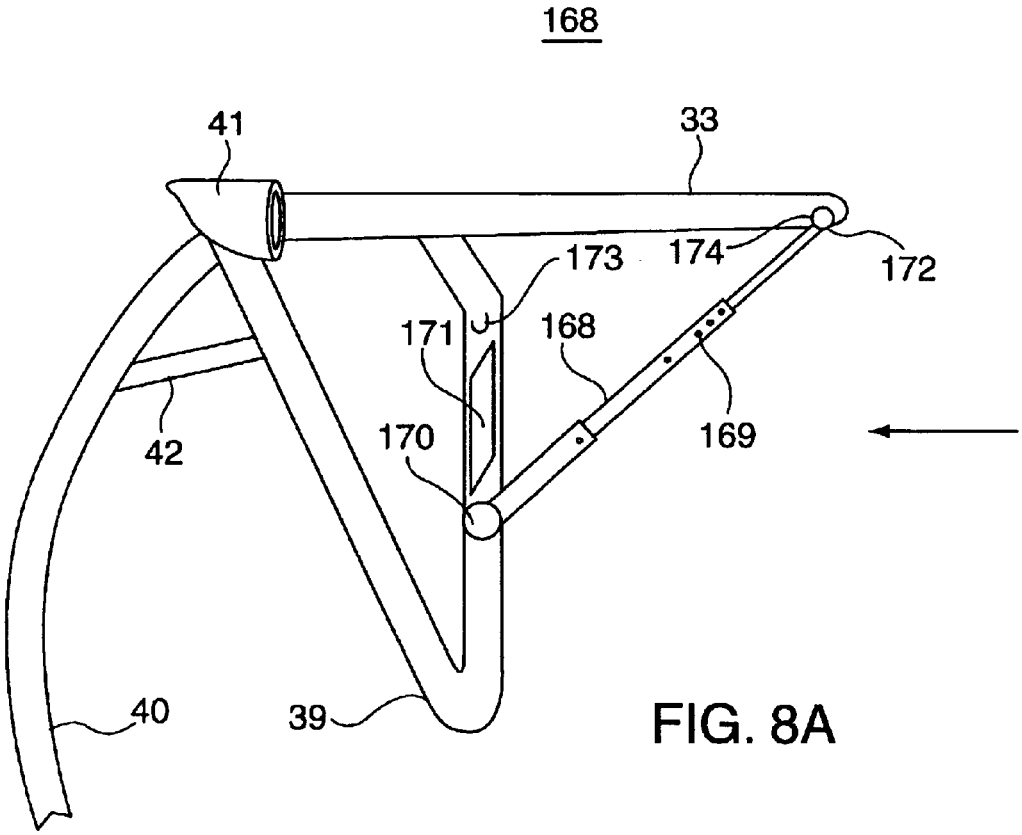
FIGS. 8A and 8B are side and front views of the components of the present invention.
Figure 8B:
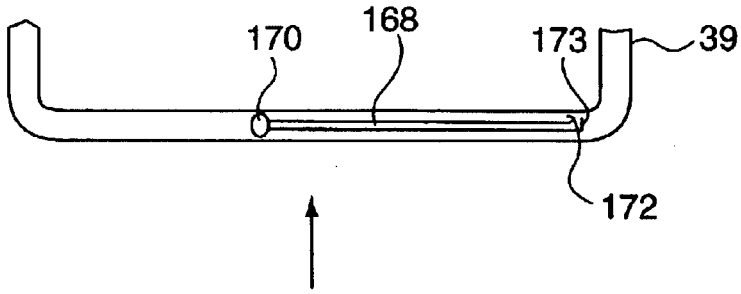

A stabilization rod 168 is inset in the center of the front leg unit 39. The stabilization rod 168 is illustrated in FIG. 8. The stabilization rod 168 is used to brace the leg rest 33 if a practitioner chooses to bear weight to the legs of the client. The rod 168 telescopes like a car antenna and when the desired length is reached it is secured into place via the use of pinhole clips 169. The rod 168, in the folded position, measures approximately 8" with a circumference of about a ½". When open for use, the rod 168 can expand up to 30" in order support the chair in the fully reclined position. To the base of the rod is welded a ¼" ball 170 that is inset into the center of the tubular frame of the front leg unit 39. When not in use the rod 168 rests flush in a concavity 171 that runs horizontally along the front leg unit 39 and its tip 172 snaps into a lip 173 on the tubular frame so that the rod is stationary when the chair is transported. To stabilize the leg rest 33 of the chair, the practitioner lifts the rod 168 from its housing 171 brings it to a position that is perpendicular to the horizontal frame, presses in the pins and telescopes it to the desired length then releases the pins to set in their holes. The tip 172 is then inserted into a hole 174 on the underside of the leg rest 33 of the chair. The ball 170 that is at the base of the rod and inset in the front leg unit 39 allows for the rod to be set at an angled distance from the front leg unit 39 to the leg rest 33.

As shown in FIG. 6, utility pockets 58 and 59 can also be provided in the outer backside of the chair. The utility pockets can be used for the practitioner's supplies.

The Chair 1000 can also be provided with various accessories. Some of the presently contemplated accessories are:

1. Relaxer Wedge System

The Relaxer Wedge System comprises a set of additional pillows to "comfort fit" any individual's different structural needs. For example, a person's foot/feet may be rotated laterally (outward) due to certain pathologies of that person's hip, leg, foot/feet, etc. This lateral position is not conducive to the work of the practitioner. When the client's foot is angled outward, if the practitioner does not frequently reposition it to a vertical position, the practitioner tends to, most times unknowingly, lean with the angle of the foot in order to manipulate it thus leaving the practitioner susceptible to employing improper body mechanics. In order to correct this/these lateral rotation(s) prior to starting a session the practitioner can situate the appropriate pillow(s) from the Wedge System along side the client's leg(s) in order for the foot/feet to be in a more mechanically correct position for practitioner access.

2. Relaxer Carrying Case

A portable carrying case can also be provided. The case houses the folded/closed Reflexology Chair for easy transport.

3. Disposable Towel Dispenser

A Disposable Towel Dispenser can also be provided. The travel dispenser can be attached to the Chair 1000 with S hooks. The towels will be used to cover the head and/or footrest pillows.

4. Disposable Sani-Cover Dispenser

A Disposable Sani-Cover Dispenser can be provided and attached to the chair via "S" hooks. The sani-cover is one continuous sheet of lightweight paper and is used to cover the entire chair from head to foot. This is especially useful for practitioners who may wish to use the chair for sporting events/expos where there is a high turnover of clients throughout the day.

5. Foot Boot/Leg Warmers

These boots are designed as ankle-high boots with a leg warmer extension that will go to the knee. The leg warmer can be used separately or in conjunction with the foot warmer. They are designed with soft, thick material such as flannel that is filled with flaxseeds or another suitable material. The booties may be placed in a microwave oven to be heated prior to use if heat is indicated. Two boots can be applied to both feet pre/post session to improve circulation and enhance relaxation.

6. The Back Muscle Trigger Point Reliever and Lamina Groove Pad

This is a lightweight padded mat that incorporates high-grade plastic balls between the layers of its padding. The foam padding is covered with the same material as the chair. The Pad attaches to the back of the chair via "S" hooks that are placed into two holes on the top of the back frame 1 at the head section of the chair. The Pad is then fitted to the back seat 6 where the client's back will ultimately rest. The pad 86 covers the area from the head to the sacrum measuring about 22" wide and 28" long. The plastic balls 87 are arranged to target classic trigger points in the back muscles and also along the lateral edges of the spine in the anatomical area known as the lamina groove. When the Pad 86 is in place and the eight of the client's back is pressed against it and using gravity as a partner it will relieve trigger points in the muscles that rest on the balls 87 of the mat.

7. Attachable Plastic Cup

A plastic cup can also be provided. This is a plastic cup with a plastic hook on its rim that fits into one of the slots 31 which are part of the armrests 15 of the chair.

8. Child Booster

A Child Booster seat is a seat that measures 24" wide and is designed to fit the contour of the back and seat of the chair. It serves as a chair within a chair that is used to accommodate the small frame of a young child.

9. Practitioner Mat

The Practitioner Mat is 1" thick firm rubber that is covered in the same material as the chair. It is designed in the shape of a "U". It is placed on the floor around the chair for the practitioner to kneel on when using certain bodywork techniques that go beyond the scope of foot or hand reflexology.

10. Acupressure Magnetic Mat

The Acupressure Magnetic Mat fits the entire length of the chair and stimulates posterior body reflexes and acupressure points on the client's back during a session.

11. Compact Disc Pocket Holder

The Compact Disc Pocket Holder is a clear plastic pouch measuring approximately 6"×6" that attaches to the back frame 1 of the chair via an "S" hook 97 that is placed into a hole 3 on the top of the back frame 1 of the head section of the chair. The pouch 96 will hold a "walkman" style, battery operated compact disc player.

12. The Reflexology Hand Roll Bar

The Reflexology Hand Roll Bar is a hollow tubular bar that measures 30" long, has a circumference of about 4" and is made of ebonite. When in position the bar is situated above and across the clients lap. The client simply rolls the palm surface of their hands over the bar in order to stimulate the reflexes in their hands.

13. Flexor Strengthener Glove

The Flexor Strengthener Glove is a 2"×16" band of rubber with 4 rubber rings attached perpendicularly in the center. The clients' fingers insert into the 1" thick rubber rings in order for the client to perform active assisted flexor strengthening exercises under the guidance of the practitioner.

14. Fancy Footwork Exercise Power Band

The Fancy Footwork Exercise Power Band is a leg/ankle muscle strengthening resistance band made of heavy durable rubber that attaches to the foot of the leg rest of the chair. The client, with instruction and assistance from the practitioner, can strengthen leg/ankle muscles by the use of resistance.

15. Public Privacy Hood

The Public Privacy Hood is a three-sided hood that is designed to snap into holes on the side bar of the back frame 1 at the head/shoulder area of the frame of the chair. The Hood ensures the clients privacy when sessions are performed in public places. It is designed in such a manner that it does not obstruct the practitioner's view of the client's face.

16. The Rainbow Sweeper

The Rainbow Sweeper is a bristled brush measuring about 18" wide, ½" thick and 5" high. The Sweeper fits comfortably in one hand and is used to "sweep" the chair, with one long sweeping motion, from head to foot. It will effectively remove any lint or debris that has accumulated on the material of the chair.

17. The Hand Stabilizer

The Hand Stabilizer is a 2"×16" band of leather with 4 adjustable rings sewn perpendicularly in the center. Practitioners performing specific techniques to the carpal tunnel area of the wrist (i.e., Neuromuscular Therapy or muscle striping) will find this useful to keep the hand and arm in the correct position to perform such techniques.

18. The Rainbow Wrist Bolster

The Rainbow Wrist Bolster designed in the shape of a dome is made of hard sponge like rubber material that is about 3" high×5" wide. The bottom surface of the bolster is convex to custom fit into the concave grooves of the upper cushion of the armrests of the chair. The bolster fits under the wrist with either the palmer side of the hand up or down assuring the proper positioning or arch to the wrist during a Proprio-Neuromuscular Facilitation (PNF) session of the flexor/extensor muscles of the arm.

19. The Portable Magnifier Lamp

The Portable Magnifier Lamp is a combination light and magnifying glass that snaps on to the steel tube frame of the chair at the foot or hand area. The Magnifier Lamp is used by the practitioner to take note of any pathologies or changes in the integrity of the skin/nails on the hands/feet.

20. The Reflexology Data Capture System

The Reflexology Data Capture System is a portable electronic device that clamps onto the underside of the armrest of the chair. There is a touch-sensitive cylinder, made of anti-microbial steel, that is attached to the upper end of a "C"-shaped clamp. The bottom of the "C"-shaped clamp fits into a slot that is built into the plastic underside of the armrest. In the middle of the clamp there is a pivot hinge that enables the clamp to turn out and away from the armrest allowing it to remain attached but out of the way of the client when it is not being used.

The practitioner enters all standard client data such as running log number, client number, client last name, client first name, date, time, session number, etc., into the palm pilot. The keyboard also enables the practitioner to enter notes pertinent to the reflexology session. The information is ultimately transferred to a main computer. This device is especially useful for collecting and collating data for client documentation, case histories and clinical research studies.

Although the inventions of the accessories have been described in their presently contemplated best mode, various modifications, modes of operation and embodiments are possible. These present inventions should in no way be limited to the preferred embodiment enclosed herein.

The use of the reflexology Chair 1000 for reflexology session will now be described. The first step is to unfold the Chair 1000. Unfolding the Chair 1000 involves one easy step or movement: the chair is pulled apart from a folded position to a fully reclined, horizontal position (head back/leg rest up) so that the base is fully open and stable then inclining the head to a vertical position so that the leg rest automatically moves from the horizontal to vertical position. That being done the chair is in a position that is ready to receive a client in the seated position as shown in FIG. 1. While the chair is being opened and throughout the entire procedure it is important for the practitioner to disengage the brake mechanism by releasing the lever 47 under the armrest.

Before the client is seated and likely while the chair is in the reclined position, the contoured leg cushion that will rest beneath the knee 36 is snapped into place. And the desired cushion for the leg 38 is also snapped around the tubular frame of the chair and secured into place.

The ergonomically designed chair is unfolded and prepared for the client to be seated. The client sits in the chair. The practitioner depresses the lever 47 beneath the right armrest in order to disengage the brake mechanism.

The practitioner inclines the chair back which brings about a similar inclination of the leg rest thus raising the feet and releases the lever re-engaging the brake shoe and securing the chair in the desired reclined position. The client is now in a lying down position.

Once the client is reclined the practitioner moves to the foot of the chair to determine if and how much the lower end of the leg rest section of the chair needs to be adjusted. It is most desirable for the client's feet to be flush to the edge of the frame of the chair. The practitioner then presses the pins that are secured into the holes 35 on the left side of the frame of the leg rest of the chair. She/he pulls the tubular frame out (if lengthening the chair for a tall client) to the desired length so that the client's feet are flush to the edge. Once the desired length is reached the practitioner releases the pins and lets them rest in the holes of the tubular frame and the frame is locked in at the desired length. This procedure will work the same way when adjusting the chair for a shorter person except the tubular frame of the leg rest will be pushed in to shorten the leg rest.

If the chair is lengthened it may be necessary to add an additional cushion to the leg rest portion in order to accommodate the client's leg length. The additional cushion 36 is easily snapped 36 into place around the tubular frame of the leg rest 33 and the Velcro on its edge 178 is pushed up against the Velcro edging of the cushion 179 behind and/or in front of it. The Velcro assures that the cushions are firmly in place leaving no gaps for sagging and offering a stable surface for the client's legs and feet to rest.

At this point the practitioner may decide, depending on the height and weight of the client and the type of work the practitioner will perform on the client's legs/feet, to engage the stabilization rod 168. The practitioner reaches down to the front leg unit 39, lifts the stabilization rod from its housing 171 that is built into the front leg unit, pivots its base 170 in the socket to face the foot end of the chair, presses the pins inward and telescopes it open to the desired length, releases the pins to set/lock into their holes and inserts the tip 172 into a hole 174 on the underside of the leg rest 33 of the chair. The stabilization rod is at an approximate 45 degree angle from the leg unit 39 to the leg rest 33.

The practitioner, still in the process of adjusting the Chair 1000 to the client's specific anatomical structure, moves to the armrests. Depending on the size/structure of the client, the practitioner will turn the screw 25 beneath the armrest of the chair in order to loosen the ball and socket mechanism 20. The armrest 15 is then lowered or raised, perhaps angled slightly upward from elbow to hand, and generally situated to allow the client to be in a completely relaxed position that requires no active effort on the part of the client.

The armrest of the chair is also contoured so as to allow for the client's forearm to be cradled within the concave groove of the armrest 18. The client's arm will not slip out of or off of the armrest at anytime during the session so the client can be completely relaxed by the "safe and sound" feeling of having her/his arm securely cradled. The thick foam cushion adds also to the client's general comfort.

The practitioner then moves to the client's head. There is a pillow 159 attached to the tubular frame 1 at the head area. The practitioner separates the strap 166 that held the pillow in place during transport and adjusts the U-shaped pillow 159 to contour to the shape of the client's head/neck. Generally the back of the client's head will rest in the open central area of the pillow 162 and the client's neck will rest on the bridging section 161. The client may also adjust this to his/her comfort and any position at any time during the session.

Before the client was seated, different colored gemstones or perhaps other types of healing instruments were placed in the semi-circular inside pockets on the head 4, upper back 156 and lower back 6 section of the chair. The healing instruments were placed according to the alignment of the chakra energy centers in the body. During the initial assessment of the client the practitioner determined what instruments to use and where to place them according to the client's needs.

Once the client is comfortably positioned in the chair, the practitioner fills the specially designed cup 89 with water, juice, etc., replaces the lid and places a disposable straw in the cup through the hole in the lid. The cup has a clip/hook 90 on its rim that fits into a built in slot 31 on the outside of either armrest. The glass of water or other fluid is easily and readily available to the client at any time during the session.

The practitioner may decide to make use of the Reflexology Data Capture System 153 either for clinical research purposes or simply for standard client documentation. The practitioner sits in a secretary chair at the foot of the client and makes note of the time by looking at the illuminated clock 32 that is inset in the front left armrest 15. The practitioner begins the session. The actual procedure and order of the session is as varied as the practitioners giving it. Basically the practitioner assesses the condition of the feet from many different perspectives. She may decide to attach the Portable Magnifier Lamp 122 to the tubular frame of the chair in order to take a closer look at any pathologies on the skin or nails of the feet. Once attached, she would pull the light fixture 128 away from the body of the lamp 126 in order to activate the batteries to turn on the light. The light on, she slides out the rectangular shaped magnifying glass 130 that is stored within the body of the lamp and takes a close look at the feet.

She then begins performing a variety of biomechanical warm-up type exercises. From this point on many practitioners will begin administering Reflexology.

The practitioner may decide that the client would benefit from the use of leg strengthening exercises. She would then attach the Fancy Footwork Exercise Power Band to the horizontal cross bar on the leg rest 33 of the chair. This is applied in a similar fashion to that of putting on a belt. One end of the Band has a slit and the other end is wrapped around the tubular frame of the leg rest then slipped through the slit thus securing it to the chair. The client, with assistance and instruction from the practitioner, can strengthen leg and ankle muscles by the use of resistance.

During the session the practitioner may need to adjust the height of the client's feet or legs. If the stabilization rod is not being used the practitioner will simply depress the lever 46 at the foot of the leg rest 33 in order to disengage the brake mechanism. The practitioner moves the leg rest up or down accordingly, and this may only be an inch or two, releases the lever and re-engages the brake.

When the practitioner depresses either of the levers 46 or 47 for the brake mechanism, the lever engages the cable 49 that is attached to the brake shoe housing 51 or 54 and subsequently the brake shoe 48 or 53 is pulled away from the grooved slide rod 16 or 16*a*. The separation of the brake shoe from the slide rod enables the movement of the slide rod through the sliding forked yoke 17. The top of the leg rest 33 is connected to the slide rod by a cylindrical hinge 34 that acts as a pivot pin and is perpendicular to the plane of symmetry of the chair. Within the cylinder is a hinge joint for the sliding rod and another hinge joint for the leg rest. So basically, the articulation of the leg rest to the slide rod and the slide rod to the back frame enables the practitioner to incline the leg rest while the brake shoe is disengaged and the back rest is inclined simultaneously in one smooth movement. When the chair is in the desired position the practitioner releases the lever 46 or 47 and the brake is once again engaged and the chair is locked into position.

If the stabilization rod 168 was engaged at the time that the practitioner needed to adjust the height of the chair then she would, before disengaging the brake, simply remove the rod from the hole in the leg rest 174 and proceed as above, and with the chair locked into the new position, adjust the length of the rod with the touch of a finger on the pinhole clips 169, then re-attach it to the hole in the leg rest.

While the practitioner was working on or reflexing the client's feet the client may have been making use of the Reflexology Hand Roll Bar 98. Before the session on the feet began the practitioner would have placed the bar across the client's lap. The rounded ends 100 of the bar fit rested in the concave grooves of the upper cushion 18 of the armrests 15. At any time during the session, the client could roll the palm of her/his hand over the bar and stimulate the reflexes of the hands while the feet were being worked on.

Before ending the session on the lower extremities the practitioner may decide to perform other types of bodywork that would entail the practitioner kneeling at the side or feet of the client. The practitioner would then use the Practitioner Mat, designed in the shape of a "U", and placed on the floor around the chair thus offering a cushioned kneeling place for the comfort of the practitioner.

The session on the feet is now completed. The practitioner is now going to administer reflexology to the client's hands.

The practitioner disengages the stabilization rod 168 from the hole in the leg rest 174 depresses the pinhole clips 169, presses, from the top of the bar down, to close the antenna like rod and rests it in its housing 171 on the front leg unit 39 then snaps the tip 172 into the lip 173 on the tubular frame of the front leg unit.

The practitioner moves in her chair up along side of the clients arm and prepares to reflex the hands. In order for the practitioner to access the client's hand and arm for easy manipulation the practitioner must first adjust the armrest. She turns the easily accessible turn screw 25 that is positioned on the lateral/outer side of the armrest in order to loosen the ball 23 or 138 from its socket 24 or 139. Once the turn screw is loosened the armrest can be moved to any position the practitioner desires. In this case it is likely that the client's arm will be abducted to somewhere between 30 and 45 degrees outward. While the client's arm is still rested on the cushion of the armrest the practitioner simply holds the armrest and swivels it out and/or moves it up or down. She may also want to slide it back or forward a little to situate the client's arm so that the hand is to the edge of the armrest. She then depresses the pin balls 144 on the outer side of the slide bar 143, pulls the armrest forward or pushes it backward so that the slide bar 143 glides through the two railed guide track 145 that is attached to the underside of the armrest 19, releases the pin balls and secures the armrest. Once the arm is situated the practitioner turns the turn screw to tighten the ball and socket and secures the armrest in place.

The practitioner is now ready to proceed with a manual application of reflexology to the client's hand and arm. During the session the practitioner may decide to use the Hand Stabilizer to immobilize the client's hand so she can use specific techniques such as muscle stripping or some other type of neuromuscular therapy to the carpal tunnel area of the wrist. The practitioner takes the 16" band of leather and wraps it around the armrest. There is Velcro on either end of the strap and the practitioner simply adheres one end of the band to the other so that the Hand Stabilizer is in position for use. The client's fingers are inserted into the 1" thick leather rings 119 and adjusted one at a time. The client's hand is now immobile and ready for the practitioner. When finished the practitioner simply releases the bands from around the client's fingers, reaches below the armrest, pulls the strap open, removes it and places it to the side.

If the practitioner should decide to apply Proprio-Neuromuscular Facilitation to the flexor/extensor muscles of the clients arm during the session she would use the Rainbow Wrist Bolster. The bottom surface of the Bolster is convex and custom fits into the concave groove of the upper cushion 18 of the armrest. The bolster fits under the wrist of the client with either the palmer side of the hand up or down thus assuring the proper positioning or arch to the wrist during the PNF session.

Reflexology to one hand is now complete and the practitioner moves her chair to the other side and proceeds with the session on the other hand. She will adjust the armrest accordingly and follow the same process as with the first hand.

Having completed the foot and hand reflexology the practitioner may now decide to perform bodywork to the client's neck, shoulders and upper back. She depresses the lever 47 under the armrest in order to disengage the brake mechanism, inclines the chair so that the client is in a seated position and releases the lever to re-engage the brake mechanism. She adjusts the armrests to custom fit the clients new position by simply loosening the turn screw, moving the armrest to the desired position and tightening the turn screw so that the armrests are stabile.

The practitioner moves to the head of the client and standing behind the chair detaches the snap-on cuffs 5 on the sides and cross bar of the back frame 1, pulls the Velcro 154 apart from the cushion below it and removes the cushion 4. The cross bar of the back frame may be obstructing the practitioner's access to the clients neck so she simply depresses the pin balls on both sides of the frame and slides the frame up by an inch or two. She then releases the pin balls and the frame is locked into its new position. The client's neck and shoulders are now exposed and the practitioner can perform massage, acupressure or any other type of bodywork to the area.

The practitioner is now ready to massage the upper back of the client and proceeds to remove the upper back cushion 156. She unsnaps the cuffs 157 from the side tubing of the back frame 1 and folds it down from the frame leaving it hanging down behind the chair and still attached to the cushion of the lower back 6. The practitioner proceeds to work the back muscles of the client.

When the work to the upper back, shoulders and neck is completed the practitioner lifts the upper back cushion 156 and snaps the cuffs 157 into place around the tubing of the frame. She then depresses the pin balls on the side of the frame and lowers the frame to its original position and releases the pin balls in order to lock the frame back into position. Finally she takes the head cushion 4, wraps the upper cuff around the horizontal bar of the back frame, snaps the cuff to the back of the cushion, snaps the side cuffs around the frame and re-adjusts the head pillow 159 for the client.

Those of ordinary skill in the art will recognize that the embodiments just described merely illustrate the principles of the present invention. Many modifications may be made thereto without departing from the spirit and scope of the invention as set forth in the appended claims.

What is claimed is:

1. A portable collapsible chair adapted for facilitating ergonomics required for a reflexology therapy session provided by a therapist to a client comprising:

a) a collapsible frame comprising a back portion and a leg portion;

b) armrests pivotally attached to the collapsible frame;

c) a plurality of cushions attached to the back portion and leg portion of the collapsible frame;

d) means for providing adjustment to the height of the back portion of the frame to accommodate the client's height;

e) means for providing adjustment to the length of the leg portion to accommodate the client's leg length;

f) a pair of guiding forked yokes attached to the frame to help support the client's weight;

g) an adjustable removable head pillow to support the client's neck; and h) means for locking the chair in place after adjustments are made to fit the chair to the client's physical size and dimensions.

2. A method for performing a reflexology therapy session comprising the following steps:

a) providing a portable collapsible chair comprising a collapsible frame comprising a back portion and a leg portion;

b) providing armrests pivotally attached to the collapsible frame;

c) providing a plurality of cushions attached to the back portion and leg portion of the collapsible frame;

d) providing means for providing adjustment to the height of the back portion of the frame to accommodate the client's height;

e) providing means for adjustment to the length of the leg portion to accommodate the client's leg length;

f) providing means for helping to support the client's weight;

g) providing an adjustable and removable head pillow to support the client's neck;

h) providing means for locking the chair in place after adjustments are made to fit the chair to the client's physical size and dimensions;

i) adjusting the chair to fit the particular anatomy of the client;

j) locking the chair into place after adjusting the chair to fit the anatomy of the client; and k) performing reflexology therapy on the client.

* * * * *